US010879587B2

(12) United States Patent
Andujar Linares et al.

(10) Patent No.: US 10,879,587 B2
(45) Date of Patent: Dec. 29, 2020

(54) WIRELESS DEVICE INCLUDING A METAL FRAME ANTENNA SYSTEM BASED ON MULTIPLE ARMS

(71) Applicant: Fractus Antennas, S.L., Barcelona (ES)

(72) Inventors: Aurora Andujar Linares, Barcelona (ES); Jaume Anguera Pros, Vinaros (ES); Carles Puente Baliarda, Barcelona (ES)

(73) Assignee: Fractus Antennas, S.L., Barcelona (ES)

( * ) Notice: Subject to any disclaimer, the term of this patent is extended or adjusted under 35 U.S.C. 154(b) by 483 days.

(21) Appl. No.: 15/434,960

(22) Filed: Feb. 16, 2017

(65) Prior Publication Data

US 2017/0237151 A1 Aug. 17, 2017

Related U.S. Application Data

(60) Provisional application No. 62/295,577, filed on Feb. 16, 2016.

(51) Int. Cl.
*H01Q 1/24* (2006.01)
*H01Q 5/335* (2015.01)
(Continued)

(52) U.S. Cl.
CPC ..... *H01Q 1/243* (2013.01); *H01Q 1/38* (2013.01); *H01Q 5/328* (2015.01); *H01Q 5/335* (2015.01); *H01Q 9/42* (2013.01)

(58) Field of Classification Search
CPC ..... H01Q 1/38; H01Q 9/42; H01Q 5/335; H01Q 5/328; H01Q 1/243
See application file for complete search history.

(56) References Cited

U.S. PATENT DOCUMENTS 7,683,839 B2 3/2010 Ollikainen et al.
7,876,274 B2 6/2011 Hobson et al.
(Continued)

FOREIGN PATENT DOCUMENTS

CN 104022349 A 9/2014
EP 2731194 A1 5/2014
(Continued)

OTHER PUBLICATIONS

Bilton, N; The Check is in the mail, from Apple, The New York Times, Apr. 23, 2013.
(Continued)

*Primary Examiner* — Graham P Smith
*Assistant Examiner* — Jae K Kim
(74) *Attorney, Agent, or Firm* — Edell, Shapiro & Finnan, LLC

(57) ABSTRACT

A metal frame antenna (MFA) system comprises multiple arms developed to cover multiple ranges of frequencies normally required in a wireless device such as a phone. The MFA system comprises a ground plane layer, a first electrical arm including a strip element at an edge of a phone spaced apart from an edge of the ground plane layer, a second electrical arm comprising a strip element and/or an antenna booster, a branching system connecting the first and second arms to a feeding system that is connected to the RF system of the phone.

20 Claims, 4 Drawing Sheets

(51) Int. Cl.

| | |
|---|---|
| ***H01Q 5/328*** | (2015.01) |
| ***H01Q 9/42*** | (2006.01) |
| ***H01Q 1/38*** | (2006.01) |

(56) References Cited

U.S. PATENT DOCUMENTS

| | | | | |
|---|---|---|---|---|
| 8,253,633 | B2 | 8/2012 | Sanz et al. | |
| 8,786,500 | B2 | 7/2014 | Eom et al. | |
| 9,160,056 | B2 * | 10/2015 | Nickel | H01Q 9/42 |
| 9,166,279 | B2 * | 10/2015 | Jin | H01Q 1/44 |
| 9,203,140 | B2 | 12/2015 | Yong et al. | |
| 9,203,456 | B2 | 12/2015 | Teng et al. | |
| 9,246,221 | B2 * | 1/2016 | Jin | H01Q 1/243 |
| 9,444,141 | B2 | 9/2016 | Asrani et al. | |
| 9,711,841 | B2 | 7/2017 | Yong | |
| 2006/0082504 | A1 | 4/2006 | Chen et al. | |
| 2010/0109967 | A1 * | 5/2010 | Ranta | H01Q 1/243 343/853 |
| 2012/0229347 | A1 * | 9/2012 | Jin | H01Q 1/44 343/702 |
| 2014/0292590 | A1 * | 10/2014 | Yoo | H01Q 1/243 343/702 |
| 2014/0300518 | A1 | 10/2014 | Ramachandran et al. | |
| 2016/0028152 | A1 | 1/2016 | Anguera et al. | |
| 2016/0111790 | A1 | 4/2016 | Anguera et al. | |
| 2017/0214776 | A1 | 7/2017 | Andújar et al. | |
| 2017/0237151 | A1 * | 8/2017 | Andujar Linares | H01Q 1/243 343/702 |

FOREIGN PATENT DOCUMENTS

| | | | |
|---|---|---|---|
| KR | 20090016494 | A | 2/2019 |
| WO | 0122528 | | 3/2001 |
| WO | 0154225 | | 7/2001 |
| WO | 2005055562 | A2 | 6/2005 |
| WO | 2005093901 | A1 | 10/2005 |
| WO | 2007039071 | A2 | 4/2007 |
| WO | 2010015364 | | 2/2010 |
| WO | 2010015365 | | 2/2010 |
| WO | 2014012842 | | 1/2014 |

OTHER PUBLICATIONS

Cube mXTEND (FR01-S4-250), Datasheet, Fractus Antennas, 5 p., Nov. 2016.

Bar mXTEND (FR01-54-232), Datasheet, Fractus Antennas, 3 p., Nov. 2016.

Run mXTEND (FR01-S4-224), Datasheet, Fractus Antennas, 2 p., Nov. 2016.

PE64905, Product brief, Peregrine Semiconductor, 4 p., 2012.

PE64909, Product specification, Peregrine Semiconductor, 11 p., 2013.

TCP-3012H, ON Semiconductor, 9p., May 2013.

SmarTune Antenna Tuner 32CK301, Product description, Cavendish Kinetics, 10p., 2015.

SmarTune Antenna Tuner 32CK417, Product description, Cavendish Kinetics, 10p., 2015.

SmarTune Antenna Tuner 32CK503, Product description, Cavendish Kinetics, 10p., 2015.

Villanen, J. et al., Coupling Element Based Mobile Terminal Antenna Structures, IEEE Transactions on Antennas and Propagation, vol. 54, No. 7, Jul. 2006, pp. 2142-2153.

Villanen, J., Miniaturization and Evaluation Methods of Mobile Terminal Antenna Structures, Dissertation for the degree of Doctor of Science in Technology, Department of Electrical and Communications Engineering, Helsinki University of Technology, Finland, Nov. 2007.

Schroeder, W. L. et al., Utilisation and Tuning of the Chassis Modes of a Handheld Terminal for the Design of Multiband Radiation Characteristics, in IEE Conference on Wideband and Multiband Antennas and Arrays, Birmingham, UK, Sep. 2005.

Ban, Y. L. et al., A Dual-Loop Antenna Design for Hepta-Band WWAN/LTE Metal-Rimmed Smartphone Applications, IEEE Transactions on Antennas and Propagation, vol. 63, No. 1, pp. 48-58, Jan. 2015.

Valkonen, R. et al., Inherently non-resonant multi-band mobile terminal antenna, Electronics Letters, vol. 49, No. 1, Jan. 2013.

Chen, H.; Zhao, A., LTE Antenna Design for Mobile Phone With Metal Frame, IEEE Antennas and Wireless Propagation Letters, vol. 15, 2016, pp. 1462-1465.

Rowell, C.; Lam, E. Y., Mobile-Phone Antenna Design, IEEE Antennas and Propagation Magazine, vol. 54, No. 4, Aug. 2012, pp. 14-34.

Valkonen, R., Impedance matching and tuning of non-resonant mobile terminal antennas, 2013, Doctoral Dissertations 40/2013, Aalto University, Helsinki.

Díaz, V., Multiband MIMO techniques for handset devices based on ground plane boosters, Escola Tècnica Superior d'Enginyeria Electrònica i Informàtica La Salle, 2010, Barcelona.

Cihangir, A., Antenna designs using matching circuits for 4G communicating devices, Université Nice Sophia Antipolis, 2014, Nice.

Ban, Y. L. et al., Reconfigurable Narrow-Frame Antenna for Heptaband WWAN/LTE Smartphone Applications, IEEE Antennas and Wireless Propagation Letters, vol. 13, 2014, pp. 1365-1368.

Ban, Y. L. et al., Low-Profile Narrow-Frame Antenna for Seven-Band WWAN/LTE Smartphone Applications, IEEE Antennas and Wireless Propagation Letters, vol. 13, 2014, pp. 463-466.

Valkonen, R. et al., Capacitive Coupling Element Antennas for Multi-Standard Mobile Handsets, IEEE Transactions on Antennas and Propagation, vol. 61, No. 5, May 2013, pp. 2783-2791.

Ren, Y. J., Ceramic Based Small LTE MIMO Handset Antenna, IEEE Transactions on Antennas and Propagation, vol. 61, No. 2, Feb. 2013, pp. 934-938.

Wahidi, A. J., Design and Optimization of Multiple Printed Inverted-F Antennas (PIFAs) on a Semi-Populated Mobile Handset, Department of Electrical and Computer Engineering, McGill University, Montreal, Aug. 2012.

Barrio, S.C.D., Tunable Antennas to Address the LTE Bandwidth Challenge on Small Mobile Terminals: One World, One Radio, Department of Electronic Systems, Aalborg University, 2013, p. 140.

* cited by examiner

WIRELESS DEVICE INCLUDING A METAL FRAME ANTENNA SYSTEM BASED ON MULTIPLE ARMS

CROSS REFERENCE TO RELATED APPLICATIONS

This application claims priority under 35 U.S.C. § 119(e) from U.S. Provisional Patent Application Ser. No. 62/295,577, filed Feb. 16, 2016, the entire contents of which are hereby incorporated by reference.

TECHNICAL FIELD

The described system relates to a metal frame antenna (MFA) system that comprises multiple arms developed to cover the multiple ranges of frequencies normally required in a wireless device such as a phone. The MFA system comprises a ground plane layer, a first electrical arm including a strip element at an edge of a phone spaced apart from an edge of the ground plane layer, a second electrical arm comprising a strip element and/or an antenna booster, a branching system connecting the first and second arms to a feeding system, connected to the RF system of the phone.

BACKGROUND

Most cellphones and smartphones and alike mobile devices worldwide (hereinafter 'mobile phones' or simply 'phones'), as well as other wireless devices feature a customized antenna, i.e., an antenna which is designed and manufactured ad-hoc for each device model. This is because each phone features a different form factor, a different radioelectric specification (e.g., the number and designation of mobile bands ranging for instance from GSM/CDMA 900/1800 to UMTS 2100 and the multiple LTE bands) and a different internal architecture. It is known that the relationship between antenna size and its operating wavelength is critical, and since many of the typical mobile operating wavelengths are quite large (e.g., on the order of 300 mm and longer for GSM 900 and other lower bands), fitting a small antenna inside the reduced space of a mobile platform such as a smart phone is cumbersome. A typical available space inside a smart phone for an antenna is about 55×15×4 mm, which is much smaller than some of the longest operating wavelengths (e.g., below $1/6^{th}$ of such a wavelength), and it is known that when an antenna is made smaller than a quarter of a wavelength, both its impedance bandwidth and radiation efficiency are quickly reduced.

Owing to such constrains, antenna technology has evolved to provide complex antenna architectures that efficiently occupy and makes use of the maximum space available inside the mobile phone. This is enabled for instance by Multilevel (WO 0122528 A1) and Space-Filling (WO 0154225 A1) antenna technologies, which seek to optimize the antenna shape that, on a case by case basis, extracts the maximum radiation efficiency for each phone model.

While those technologies are flexible enough to provide an antenna solution for nearly every phone model and therefore, have become mainstream technologies since about the beginning of the century, they still require the use of as much available space as possible inside the phone. Very recently, some phones such as for instance the iPhone 4 and iPhone 5 series have introduced an antenna element that reuses an external metal frame mounted on the edge of the phone for radiation purposes. Those related solutions (hereinafter 'metal frame antenna' or MFA) potentially benefit from minimizing the use of the internal space inside the phone as the metal frame is casted on the phone perimeter. Also, the available length on the perimeter can be used to embed a metal frame antenna sufficiently large to match about a quarter of the longest wavelength of the phone. Despite these advantages, such MFA solutions still present some drawbacks. First, they are usually a single length element which matches eventually well one single wavelength but not the diversity of wavelengths that are available and needed in modern cellphones. Second, being an external element, its functioning is susceptible of being altered by the touch of a human user, causing a sever antenna impedance detuning or bandwidth reduction (see for instance the reported 'antennagate' problem with the iPhone 4 'N. Bilton, "The Check is in the Mail, From Apple", the New York Times, Apr. 23, 2013).

An achievable bandwidth for a single strip frame which is about the length of the upper edge of a phone (i.e., about 50 mm) has a maximum in the lower frequency region of operation of a phone, e.g., 824-960 MHz, and it severely decays in the upper 1710-2690 MHz range. This is because being a single strip element, the frame enters into a second resonance mode at the upper range and this mode inherently features a small bandwidth.

This means that, while the usual criteria 'make the antenna as large as possible to improve bandwidth' might be valid from a single-band system perspective, is no longer true for a multiband system: while the bandwidth looks optimum for the lower frequency region, it is far from optimum in the upper frequency region.

The problem is that changing the length of the strip apparently should not solve the problem. Owing to the scaling principle of Maxwell Equations, one might think that scaling down the strip would result in shifting the maximum to higher frequencies. And indeed such a maximum might become located at the upper region, but then one should expect a sever degradation in the lower frequency range as the peak moves away from such a region. One skilled in the art may think that an MFA solution based on a single-strip is not appropriate for a multiband system and therefore abandon this path of work and seek an alternative multiband solution.

SUMMARY

It is the purpose of the described system to provide an MFA antenna solution that fulfills the electromagnetic, radioelectric, mechanical and aesthetics requirements of a phone, particularly a smartphone or smartphone-like device.

The described system relates in particular to wireless devices such as phones (and their radiating systems), which can perform in two or more separate frequency regions of the electromagnetic spectrum, each of the regions including one or more frequency bands. They are generally referred to as multi-band devices (radiating systems), and are in particular for example referred to as dual-band (working in two frequency bands), tri-band (working in three frequency bands), quad-band (working and four frequency bands) and penta-band (working in five frequency bands). Standards, according to which such wireless devices (radiating systems) may comprise for example GSM or CDMA (e.g., GMS850, GSM900, GSM1800, GSM1900 and the equivalent CDMA systems), UMTS, and LTE (e.g., LTE700, LTE2300, LTE2500). The necessary frequency bands may thus, for example, be included in a lower frequency region within the range of 800 MHz and 960 MHz and an upper frequency region ranging from 1710 MHz to 2690 MHz. In some embodiments, such a lower frequency region runs from 698 MHz to 960 MHz, while the upper frequency region ranges from 1710 to 2690 MHz.

It has been found that an MFA antenna system can be developed to cover the multiple range of frequencies required in a wireless device or, more specifically in a phone, when arranged according to the described system, which is featured by a metal frame structure that comprises multiple arms. An MFA according to the described system comprises a ground plane layer; a first electrical arm including a strip element at an edge of a phone spaced apart from an edge of the ground plane layer; a second electrical arm including a strip element and/or an antenna booster or boosting element; a branching system connecting the first and second arms to a feeding system, the feeding system connected to the RF transmission and reception system (i.e., the transceiver system) of the phone.

DETAILED DESCRIPTION

Figure 1:
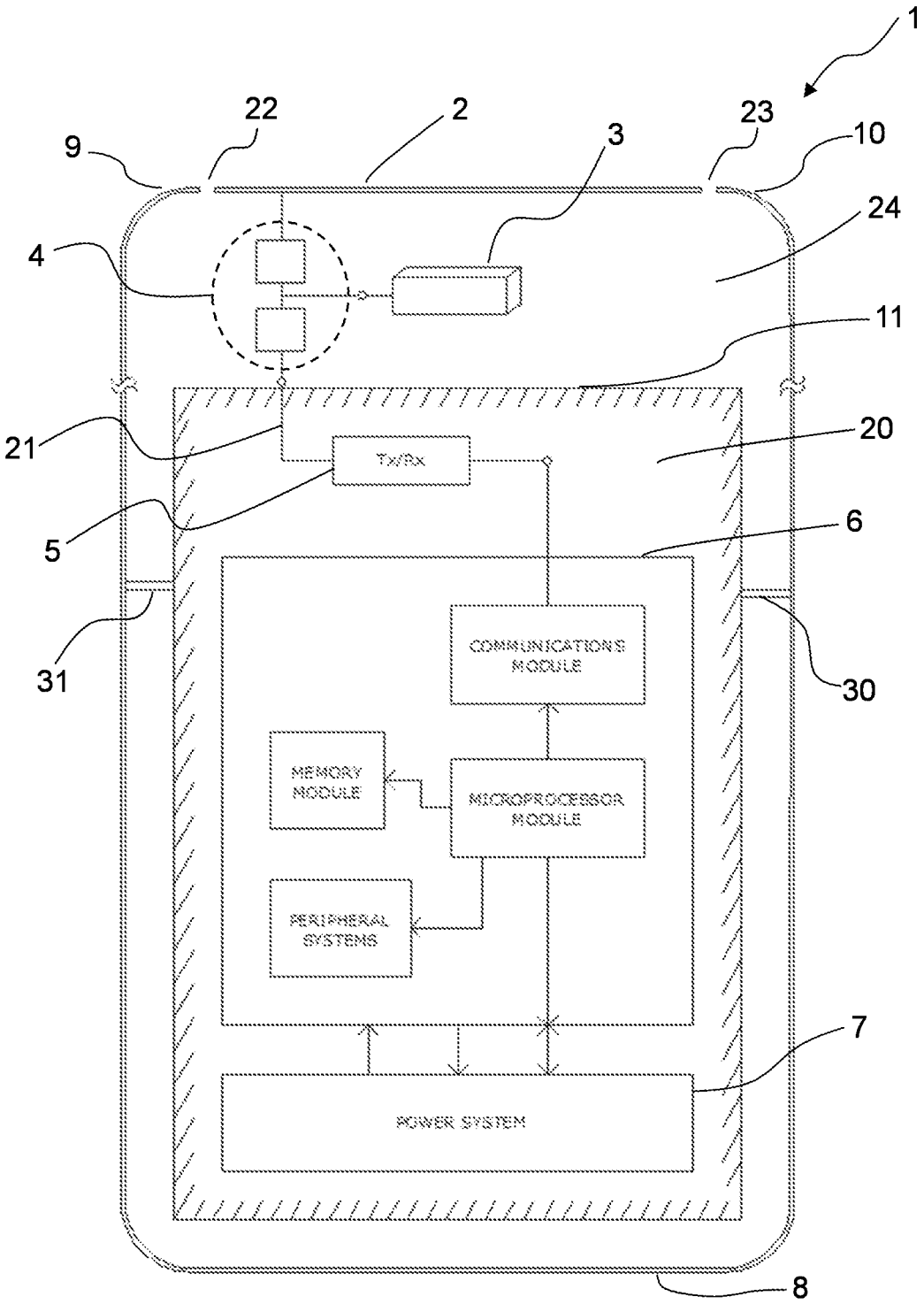
FIG. 1 shows a smartphone architecture including an MFA solution according to the described system.

An example of an MFA antenna system according to the described system is shown in FIG. 1. A smartphone 1 that includes an MFA generally includes a metal frame 8 surrounding the contour of the phone. An MFA antenna system comprises a ground plane layer 20 featuring a short edge 11. A first electrical arm includes a strip element 2 included as part of the metal frame surrounding the phone. The strip element is separated from adjacent frame elements 9 and 10 with gaps 22 and 23, respectively. A second electrical arm includes a booster or boosting element 3. A branching system 4 connects the first and second arms to a feeding system 21, and the feeding system is connected to an RF transceiver 5. A phone embodiment according to the described system usually includes other electronic modules 6, such as a communication module, a memory module, a microprocessor module and a peripheral system to control for instance input/output devices such as touch screens, USB and/or other I/O connectors. The whole system is powered through a power system 7 including for instance a battery.

An MFA antenna system as in FIG. 1 comprises a ground plane layer 20 typically implemented as a ground metal layer on a multilayer printed circuit board (PCB). Typically, the size of such a ground plane is, for a smart phone, on the order of 50 mm to 65 mm on the shorter edge, and about 120 mm to 150 mm on the longer edge and more typically, around 55 mm×135 mm. As shown in FIG. 1, the ground plane layer might be surrounded by one or more metal strips for a metal frame (e.g., metal strips 8, 9, and 10) providing a structural mechanical element for the phone while using such an element for the aesthetics finishing of the device. In some embodiments, the adjacent metal strips 8, 9, and/or 10 are connected to the ground plane layer at one or more points through connectors, as seen for instance in connector elements 30 and 31.

One of the edges of the device (the upper edge in FIG. 1) features a clearance area 24 where the ground plane layer is removed. Such a clearance area spaces apart the edge of the ground plane 11 and the strip at a first arm 2.

An MFA system according to the described system normally includes a booster or boosting element 3 at a second arm. The antenna booster might be for instance a Fractus® mXTEND product (e.g., FR01-S4-250, FR01-S4-232, FR01-S4-224). The antenna booster is connected to a branching system 4 according to the described system.

Adjacent to a strip element on the first arm 2, there are second and third metal frame elements 9, 10 which are unconnected to the first strip element. A gap between 0.5 mm and 1.5 mm, preferably about 1 mm in size, spaces the first and second or third metal frame elements. Such a gap is made so that the coupling between metal frame elements is reduced to a minimum so that the input impedance bandwidth remains about the same as the one that would be achieved without the presence of the adjacent metal frame elements.

Figure 2:
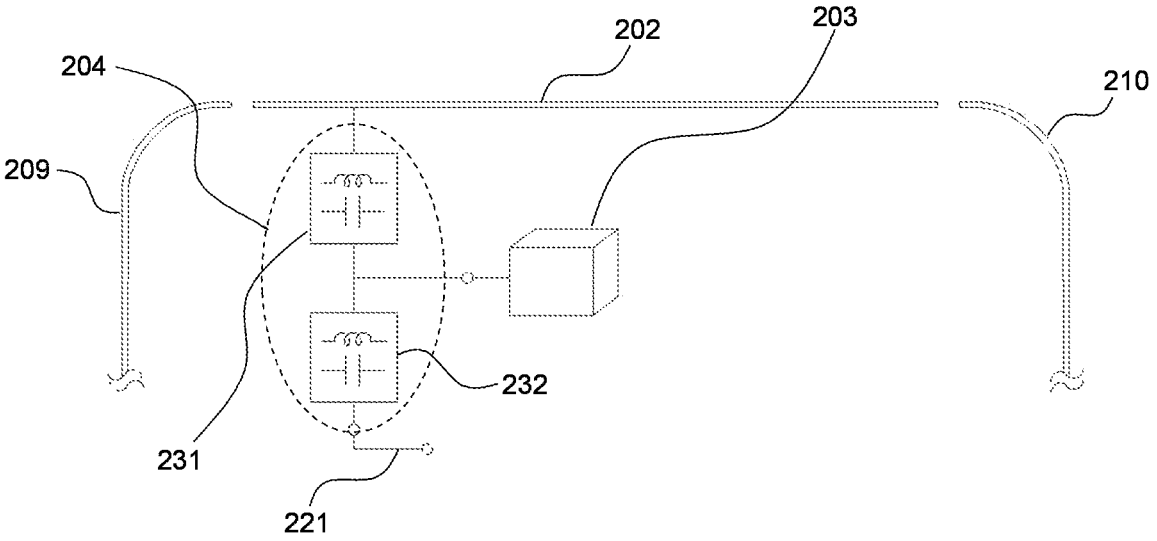
FIG. 2 shows an example of an MFA system suitable for the smartphone of FIG. 1, including two frequency selective elements in a branching system.

A more specific example of an MFA element according to the described system is shown in FIG. 2. In this implementation, a branching system 204 includes a first frequency selective electrical element 231 and a second frequency selective electrical element 232. The first frequency selective element 231 includes a low-pass filtering element that enables RF signal at a frequency within a low frequency region to flow from a feeding system 221 to a first arm element 202, while mostly blocking RF signals at a high frequency region which flow to booster or boosting element 203. First arm element 202 of the MFA antenna system is separated from adjacent frame elements 209 and 210 with gaps, in a manner similar to the corresponding arrangement shown in FIG. 1. The selective element 231 includes at least a first series inductor. In some embodiments it includes also a shunt capacitor.

The branching system 204 shown in FIG. 2 includes a second frequency selective element 232 providing impedance matching. A purpose of element 232 is to provide an impedance at the end of the feeding system 221 so that the electrical impedance of the MFA system at the two or more operating frequency bands within the upper and lower frequency regions matches the impedance of the RF transceiver. For a typical reference impedance of 50 Ohms, such a matching element provides an impedance match of a VSWR below 4.5, and quite typically below 3.5. Second selective electrical element 232 can comprise a matching network that includes an inductor and a capacitor. In some embodiments according to FIG. 2, a matching element 232 includes a tunable or variable reactive element. Such a tunable reactive element, for example, comprises or is a tunable (i.e., variable) capacitor. Possible variable capacitors that are used in such a radiating system have a capacity in a range or comprising a range from 0.6 pF to 2.35 pF or have a capacity comprising part of the range. Possible tunable capacitors used comprise, for example, Cavendish SmarTune™ Antenna Tuners, e.g., 32CK301, 32CK417, 32CK402, 32CK503, 32CK505, Peregrine, e.g., PE64905, PE64909, ON Semiconductor-ParaScan or TCP-3012H.

Figure 3:
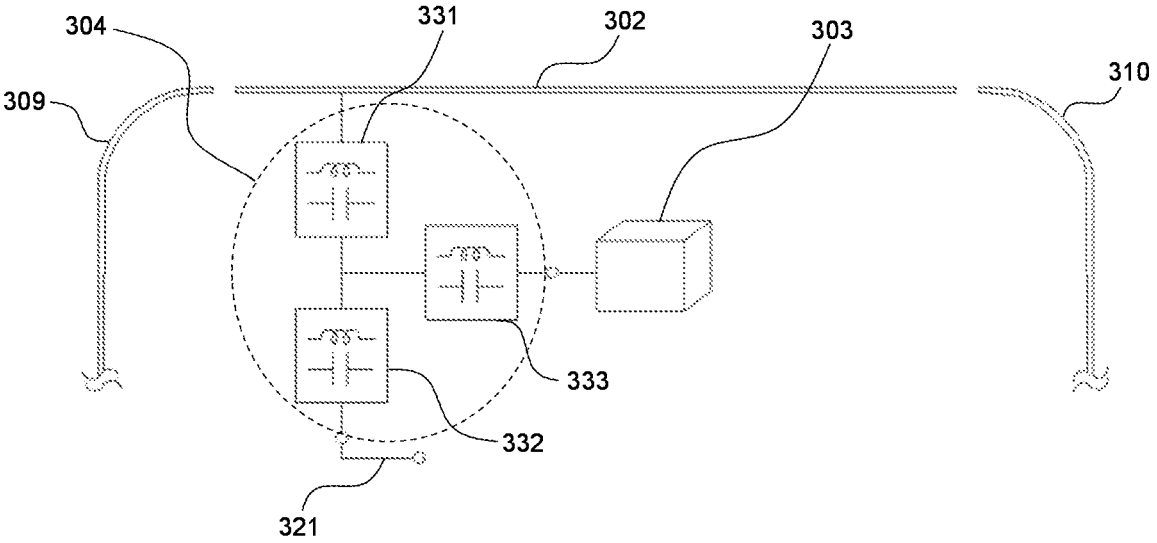
FIG. 3 shows an example of an MFA system including three frequency selective elements in a branching system.

FIG. 3 shows an implementation like that of FIG. 2 but with the addition of a third frequency selective element. Analogous to the implementation shown in FIG. 2, the MFA antenna system shown in relevant part in FIG. 3 comprises a first arm element 302 separated from adjacent frame elements 309 and 310 with gaps, and a branching system 304 including first and second frequency selective elements 331, 332. The first selective element 331 includes a low-pass filtering element that enables RF signal at a frequency within a low frequency region to flow from a feeding system 321 to the first arm element 302, while mostly blocking RF signals at a high frequency region which flow to a booster or boosting element 303. The selective element 331 includes at least a first series inductor. In some embodiments it includes also a shunt capacitor.

The second selective element 332 is analogous to second selective element 232 shown in FIG. 2 and provides impedance matching. A purpose of element 332 is to provide an impedance at the end of the feeding system 321 so that the electrical impedance of the MFA system at the two or more operating frequency bands within the upper and lower frequency regions matches the impedance of the RF transceiver.

Branching system 304 further includes a third frequency selective element 333 connecting the branching system to the second arm including the booster or boosting element 303. The element 333 normally contributes to selecting one or more frequency bands within the upper frequency region to excite element 303 within the second arm. In addition, in some embodiments, element 303 also provides impedance matching for the MFA system at the upper frequency region. In some embodiments, the frequency selective element 333 includes a series inductor, a capacitor and/or a tunable reactive element.

Figure 4:
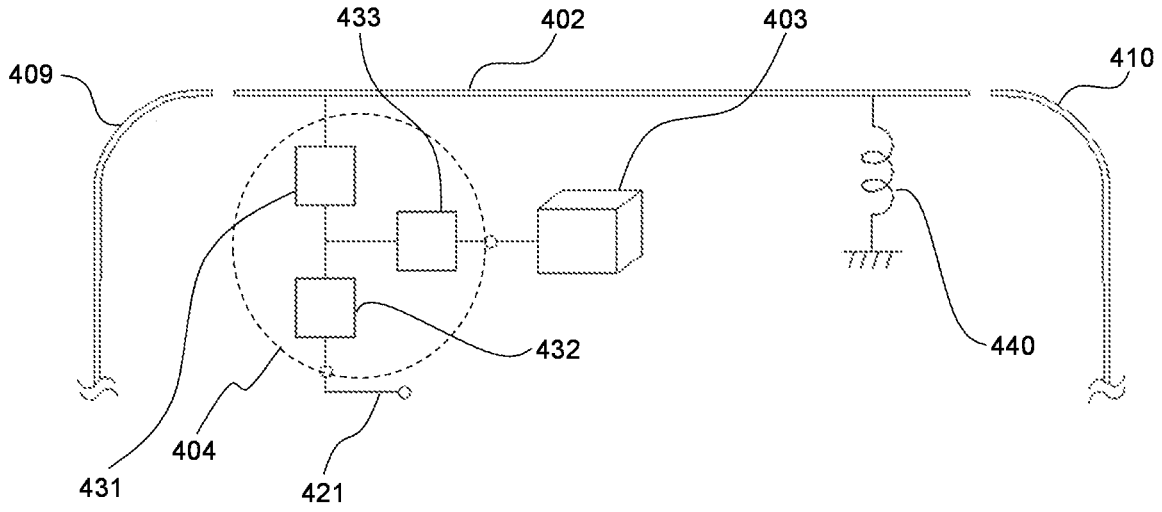
FIG. 4 shows an example of an MFA system including a reactive element connecting a first or a second electrical element and the ground plane layer of the device.

As shown in FIG. 4, the MFA antenna system may further include one or more reactive elements providing a shunt connection. Specifically, the MFA antenna system includes a first arm element 402 separated from adjacent frame elements 409 and 410 with gaps, in a manner similar to the corresponding arrangement shown in FIGS. 1-3. The MFA antenna system further includes a branching system 404 having first, second, and third frequency selective elements 431, 432, and 433 coupling first arm element 402, booster or boosting element 403, and feeding system 421 in a manner analogous to the corresponding arrangement of elements shown in FIG. 3. The MFA antenna system further includes one or more reactive elements providing a shunt connection from a first or a second electric arm to a ground conductor such as for instance a ground plane. A reactive shunt element 440 is for instance an inductor like the one shown in FIG. 4, providing DC coupling to ground to prevent the first or second arm from accumulating static electric charge that might damage the circuitry of the phone. In some implementations, such a reactive element 440 is a tunable reactive element that modifies the impedance match of the first or second arm to tune it to one or more frequency bands within the lower or upper frequency regions. Such a tunable reactive element for example comprises or is a tunable (i.e., variable) capacitor. Possible capacitors used in such a branching system have a capacity in a range or comprised in a range from 0.6 pF to 2.35 pF or have a capacity comprising part of the range. Possible tunable capacitors used comprise Cavendish SmarTune™ Antenna Tuners, e.g., 32CK301, 32CK417, 32CK402, 32CK503, 32CK505, Peregrine, e.g., PE64905, PE64909, ON Semiconductor-ParaScan or TCP-3012H.

Figure 5:
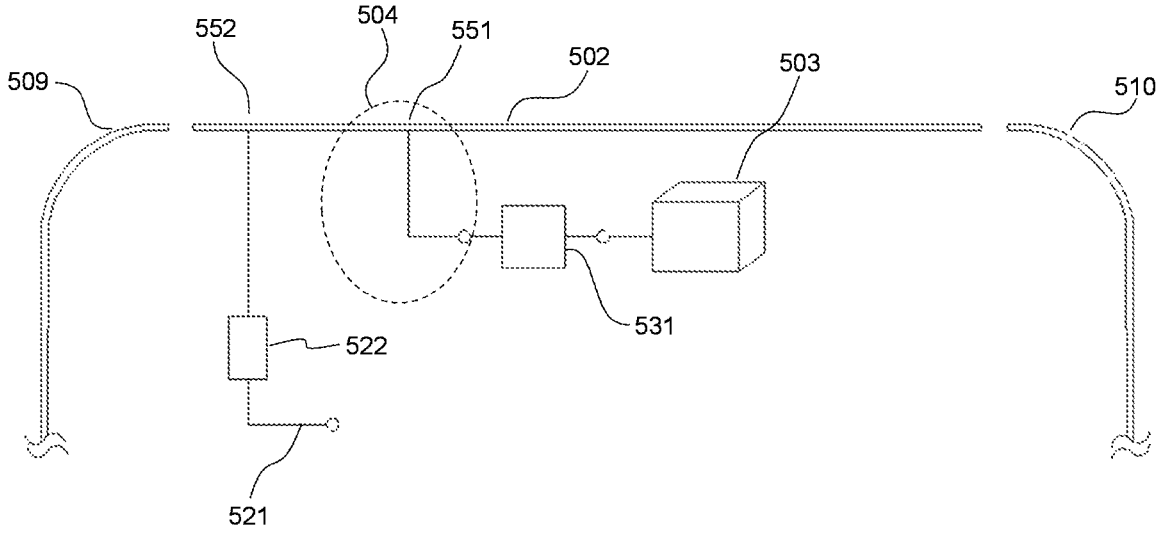
FIG. 5 shows an MFA system wherein the second arm is connected at a point of the first electrical arm.

A branching system according to some examples of the described system includes a portion of metal frame strip as shown in FIG. 5. As shown there, a strip element 502 of the MFA antenna system is separated from adjacent frame elements 509 and 510 with gaps, in a manner similar to the corresponding arrangement shown in FIG. 1. An arm of the system starts from a strip element 502 at a first point 551, and connects strip element 502 to a booster or boosting element 503 via a frequency selective element 531. Strip element 502 is connected to a feeding system 521 at a second point 552. Additionally, some implementations comprise a frequency selective element 522 in the path between second point 552 and feeding system 521, the frequency selective element providing impedance tuning capabilities to the MFA. Element 522 comprises for example an inductor, a capacitor, a tunable capacitor or inductor, or a combination of them.

Figure 6:
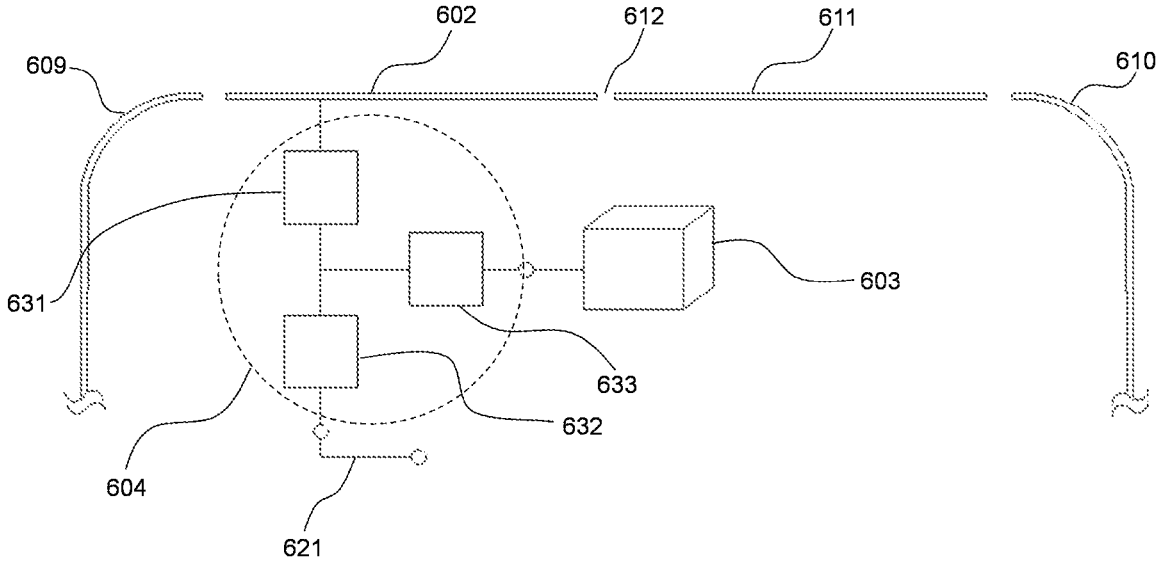
FIG. 6 shows an MFA system including a floating strip element.

In some examples, a first electrical arm according to the described system includes a single-strip frame element with a length that enables operation at both a lower and an upper frequency region, as for instance described in patent application U.S. Ser. No. 62/281,749. The entire specification of U.S. Ser. No. 62/281,749 is herein incorporated by reference. Such a length for an MFA strip element for a smartphone device according to the described system is within 20 mm to 35 mm, yet preferably a length between 22 mm and 27 mm such as for instance a value around 25 mm. The length only covers about half of the edge of a smartphone, such a strip arrangement is used in combination of a floating strip in some embodiments, as shown for instance in the embodiment of FIG. 6 and described in U.S. Ser. No. 62/281,749. A first electric arm including a frame strip 602 is mounted adjacent to a floating strip 611 which is not connected to the floating strip. Both strips are spaced apart by a gap 612, typically within 0.5 mm to 1.5 mm yet preferably around 1 mm in width, which in some embodiments minimizes the coupling between both strips. A negligible coupling is obtained when further reducing the length of the floating strip (and/or increasing the gap) does not introduce a substantial change on the radiation performance of the MFA. In some embodiments, such a coupling is introduced to combine the electromagnetic performance of the first strip with the one of the floating strip, and that is achieved by reducing the gap between both. In FIG. 6, the reference numerals 603, 604, 609, 610, 621, 631, 632, and 633 refer to corresponding elements referred to by respective reference numerals 303, 304, 309, 310, 321, 331, 332, and 333 in FIG. 3.

Figure 7:
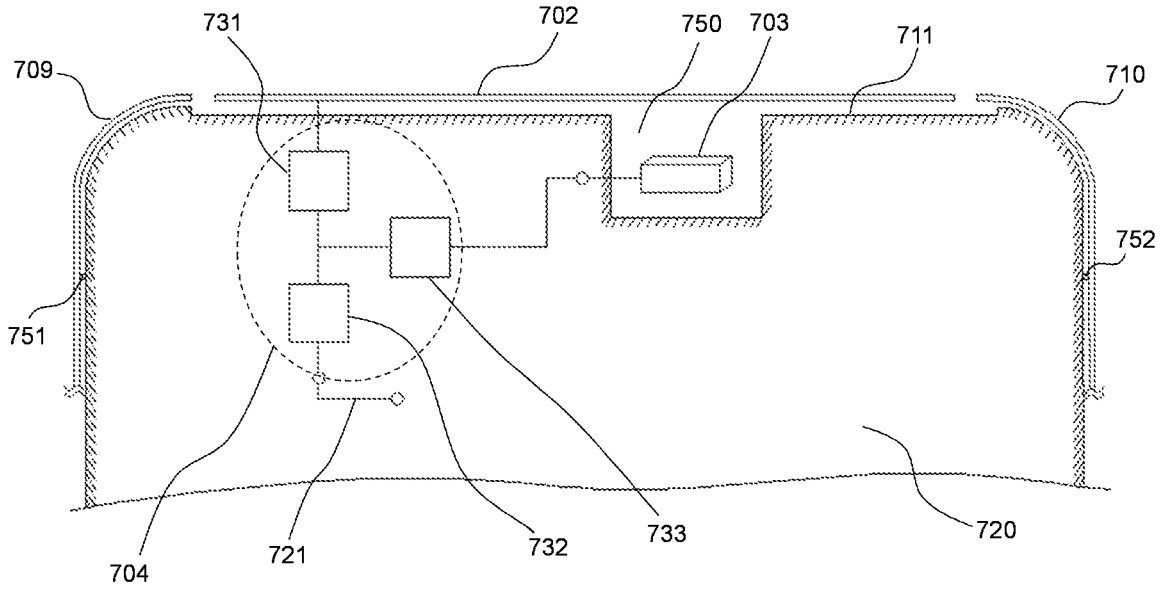
FIG. 7 shows an MFA system arranged in a minimum clearance configuration.

One of the advantages of the MFA design according to the described system is that the antenna system minimizes the footprint needed on the printed circuit board inside the phone. As shown in FIG. 7, the edge 711 of the ground plane layer 720 can be arranged in the surroundings of both the strip element 702 and the booster element 703, so that the clearance area 750 is minimized. In some embodiments, the separation between the ground layer and the closest point of either the strip element 702 or the booster element 703 can be made smaller than 1 mm. In some embodiments the MFA can be arranged with a partial clearance so that a projection of a portion of either at least one arm, a booster or both overlap a portion of the ground plane layer. A minimum or partial clearance embodiment advantageously uses a tunable reactance element in one or more of the frequency selective elements 731, 732, 733 included in the branching system 704, as a shunt element directly connected to an arm and ground plane (as shown in FIG. 4 with element 440), or as part of the feeding system 721. In some embodiments, adjacent frame elements 709 and 710 include connections to the ground plane layer as seen for instance with elements 751 and 752.

Thus, in some embodiments of the described system, the first arm comprises a first strip element included as part of a metal frame structure surrounding the contour of the phone. The strip includes two ends that are spaced apart from adjacent metal frame structures by gaps. More generally, typical gaps range from 0.1 mm to 3 mm and are used to control the coupling between the strip and the adjacent metal frame or frames. In some embodiments, the electrical coupling to the adjacent frame or frames is negligible, while in other embodiments the coupling is introduced intentionally at one or two of the ends to enhance the radiation performance of the antenna. A coupling is negligible according to the described system when increasing the gap compared to the existing one does not alter significantly the radiating characteristics of the MFA system.

In some embodiments of the described system, one or more of the at least first and second arms are mounted on a clearance of the ground plane layer. Some embodiments comprise a total clearance, which means that a projection of at least one the arm or arms on the plane including the ground plane layer does not intersect a portion of the ground plane layer, meaning that there is no intersection of the projection on any portion of the ground plane. In some embodiments the clearance is a partial clearance, meaning that there is a portion of the projection that intersects a portion of the ground plane layer, while a complementary portion of the projection does not.

In some embodiments, a branching system according to the described system includes one or more of frequency selective electrical elements. The frequency selective electrical elements are for instance a matching network, a filtering network or a combination of both. In some embodiments, a frequency selective electrical element includes an inductor, a capacitor or a combination of both. In other embodiments, a frequency selective electrical element includes a tunable (i.e., variable) reactive element such as a capacitor or an inductor. Such a tunable reactive element comprises for example a tunable (i.e., variable) capacitor or is a tunable capacitor. A variable capacitor is controlled by for example a controlling electrical digital signal or an analog signal. Possible variable capacitors used in such a branching system have a capacity in a range or comprised in a range from 0.6 pF to 2.35 pF or have a capacity comprising part of the range. Possible tunable capacitors used comprise Cavendish SmarTune™ Antenna Tuners, e.g., 32CK301, 32CK417, 32CK402, 32CK503, 32CK505, Peregrine, e.g., PE64905, PE64909, ON Semiconductor-ParaScan or TCP-3012H.

A branching system according to the described system includes a 'T' junction for an electrical circuit that splits an electrical current path into two paths. In some embodiments, the junction splits the signal into three or more paths, or alternatively, the branching system includes at least one additional 'T' junction to split sequentially into three or more current paths.

A first arm according to the described system is normally configured to enhance radiation mainly in a lower frequency region (e.g., within the 698-960 MHz frequency region). For this purpose, a frame strip comprised in the first electrical arm features in some examples a length greater than 20 mm, and preferably greater than 30 mm. In some embodiments, such a length might be substantially close or equal to the full short edge of a smartphone device, i.e., between 50 and 65 mm. In some embodiments the strip extends beyond one or more corners of the short edge of a smartphone and features a length longer than 50 mm and even longer than 65 mm, such as for instance a value within the range 65 mm and 85 mm. In other embodiments, the first arm is arranged along the longest edge of a smartphone.

A second electrical arm according to the described system includes in some examples a second strip configured to enhance radiation in an upper frequency region (e.g., 1,710-2,690 MHz). In some other examples, the second radiation arm includes a conducting strip or a conducting element featuring a length between 1 mm and 30 mm. In some embodiments, such a conducting element is connected to an antenna booster or boosting element, such as for instance those described in WO2010015365 A2, WO2010015364 A2, WO2014012842 A1 and U.S. patent application Ser. No. 14/807,449 and 62/152,991 which are included by reference herein. Example of commercial booster elements suitable for the described system is for instance Fractus® mXTEND, mXTEND RUN and mXTEND BAR range of products.

What is claimed is:

1. A metal frame antenna system for a mobile device, comprising, a ground plane layer;

a first electrical arm including a strip element at an edge of the mobile device spaced apart from an edge of the ground plane layer;

a second electrical arm including an antenna booster or a strip element;

a feeding system connected to an RF transmission and reception system of the mobile device; and a branching system including:

a junction connected to the second electrical arm;

a first frequency selective element connected between the first electrical arm and the junction, wherein the first frequency selective element includes a low-pass filtering element that enables an RF signal at a frequency within a lower frequency region to flow from the feeding system to the first electrical arm, while blocking an RF signal at a higher frequency region which flows to the second electrical arm; and a second frequency selective element connected between the junction and the feeding system.

2. The metal frame antenna system of claim 1, wherein a portion of a projection of at least one arm on a plane including the ground plane layer intersects a portion of the ground plane layer.

3. The metal frame antenna system of claim 1, wherein the second electrical arm includes a conducting strip element.

4. The metal frame antenna system of claim 1, wherein the second electrical arm includes the strip element configured to contribute to a radiation performance of the antenna system within the 1,710 MHz to 2,690 MHz frequency range.

5. The metal frame antenna system of claim 1, wherein the branching system includes a T junction that splits a signal into two paths.

6. The metal frame antenna system of claim 5, wherein the branching system includes at least one additional T junction to split sequentially into three or more paths.

7. The metal frame antenna system of claim 1, further comprising a shunt element that connects at least one of the first and second electrical arms to a ground conductor.

8. A metal frame antenna system for a mobile device, comprising, a ground plane layer;

a first electrical arm including a strip element at an edge of the mobile device spaced apart from an edge of the ground plane layer;

a second electrical arm including an antenna booster;

a feeding system connected to an RF transmission and reception system of the mobile device; and a branching system including:

a junction directly connected to the second electrical arm;

a first frequency selective element connected between the first electrical arm and the junction; and a second frequency selective element connected between the junction and the feeding system.

9. The metal frame antenna system of claim 8, wherein a portion of a projection of at least one arm on a plane including the ground plane layer intersects a portion of the ground plane layer.

10. The metal frame antenna system of claim 8, wherein the second electrical arm includes a conducting strip element.

11. The metal frame antenna system of claim 8, wherein the second electrical arm includes a strip element configured to contribute to a radiation performance of the antenna system within a 1,710 MHz to 2,690 MHz frequency range.

12. The metal frame antenna system of claim 8, wherein the branching system includes a T junction that splits a signal into two paths.

13. A metal frame antenna system of claim 8, wherein the branching system includes a junction that splits a signal into three or more paths.

14. The metal frame antenna system of claim 8, further comprising a shunt element that connects at least one of the first and second electrical arms to a ground conductor.

15. The metal frame antenna system of claim 14, wherein at least one of the first frequency selective element, the second selective frequency element, or the shunt element comprises a tunable reactive element.

16. The metal frame antenna system of claim 8, wherein at least one of the first or second frequency selective elements comprises a matching network.

17. The metal frame antenna system of claim 8, wherein at least one of the first or second frequency selective elements comprises a filtering network.

18. The metal frame antenna system of claim 1, wherein the feeding system is common to both the first and second electrical arms and is configured to enable a signal to flow from the RF transmission and reception system, through the feeding system, to both the first and second electrical arms.

19. The metal frame antenna system of claim 8, wherein the first frequency selective element includes a low-pass filtering element that enables an RF signal at a frequency within a low frequency region to flow from the feeding system to the first electrical arm, while blocking an RF signal at a high frequency region which flows to the second electrical arm.

20. The metal frame antenna system of claim 1, wherein the second frequency selective element is configured to provide an electrical impedance at the feeding system that is matched to an electrical impedance of the RF transmission and reception system at two or more operating frequency bands.

* * * * *